United States Patent [19]

Goyarts

[11] 4,206,833

[45] Jun. 10, 1980

[54] MOBILE AERIAL TOWER

[75] Inventor: Wynand M. J. M. Goyarts, Washington, Pa.

[73] Assignee: Clark Equipment Company, Buchanan, Mich.

[21] Appl. No.: 705,749

[22] Filed: Jul. 15, 1976

[51] Int. Cl.[2] ..... B66F 11/04

[52] U.S. Cl. ..... 182/2; 212/144

[58] Field of Search ..... 182/2, 141, 148; 212/144, 17; 214/86 R, 87

[56] References Cited

U.S. PATENT DOCUMENTS

| | | | |
|---|---|---|---|
| 2,965,191 | 12/1960 | Balogh | 182/63 |
| 3,262,517 | 7/1966 | Malec | 182/2 |
| 3,992,791 | 11/1976 | Dean | 212/144 |

FOREIGN PATENT DOCUMENTS

| | | | |
|---|---|---|---|
| 1366635 | 9/1974 | United Kingdom | 182/2 |

*Primary Examiner*—Reinaldo P. Machado
*Attorney, Agent, or Firm*—J. C. Wiessler

[57] ABSTRACT

A vehicle mounted aerial tower in which a primary fixed length boom is mounted pivotably from one end and extends longitudinally outwardly of the vehicle, being elevated about the pivot by a lift cylinder which is connected to the vehicle and to the boom and having mounted pivotally from the outer end of the boom a carriage assembly which supports a secondary elongated boom for pivotal movement with the carriage and actuatable lengthwise of the primary boom by sprocket and chain means, or the like, and a personnel work platform or cab pivotally supported from the outer end of the secondary boom and adapted to be maintained in a predetermined position relative to vehicle ground support. The combination of available movements of elevation of the secondary boom with the primary boom, of lengthwise actuation of the secondary boom in relation to the primary boom, and of pivotal movement of the secondary boom from the front end of the primary boom enables the personnel cab to be actuated to a variety of locations relative to the vehicle from a position well below ground level to a long forward reach position to a position of relatively high elevation.

14 Claims, 2 Drawing Figures

MOBILE AERIAL TOWER

BACKGROUND OF THE INVENTION

The field of art to which this invention pertains is mobile aerial towers, and more particularly such towers for maintenance vehicles.

Mobile aerial towers of various types have been used for a variety of purposes in maintenance vehicles, a primary objective of which is to maximize the maneuvering capability of the aerial tower and associated work platform or cab so as to provide access to overhead power lines, street lamps, upper stories in fire fighting equipment, and to levels well below the vehicle support surface for various purposes, among other applications.

Various constructions have been proposed and used heretofore, including turntable mounted elevatable telescopic boom type towers, knuckle-boom types in which a secondary boom is mounted for selected pivotal movement from a vertical "up" to vertical "down" position in relation to the remote end of an elevatable primary turntable mounted boom, combinations of telescopic and knuckle-boom towers, and combinations of primary and secondary booms in which the secondary boom may be actuated as on a trolley means lengthwise of the primary boom and elevatable relative thereto. It is common practice in such prior aerial towers to provide means for maintaining a work platform or operator's cab in a fixed level relationship irrespective of the combinations of maneuvers available to the booms and related elements of the aerial tower.

A principal object of the present invention is to provide an improved combination of aerial tower elements which increases the available maneuverability thereof.

SUMMARY

An aerial tower in which a first boom is pivoted from its one end for elevation of its remote end, a carriage assembly mounted pivotally from the remote end and supporting and guiding a second boom which is actuatable lengthwise of the trolley and is pivotable therewith from a position substantially parallel to in retracted and overlying relationship to the first boom to a position extended therefrom either parallel to the first boom or at any one of a plurality of selected angles relative thereto.

DESCRIPTION OF THE PREFERRED EMBODIMENT

Figure 1:
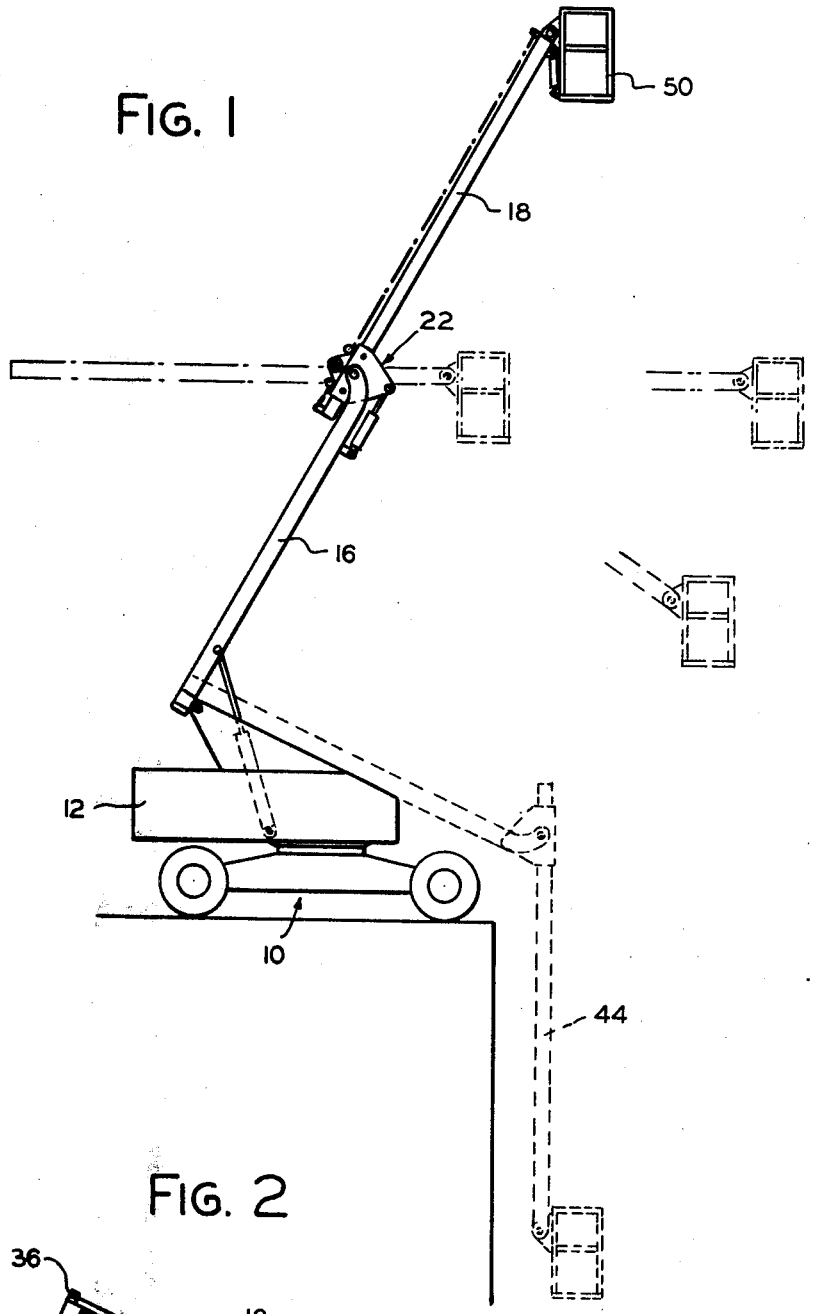
FIG. 1 is a diagrammatic view of my invention showing the mobile aerial tower mounted on a vehicle and illustrated in some of the variety of attitudes and positions available to it in relation to the vehicle and to the ground.

Referring in detail to the drawing, a wheeled prime mover operated mobile platform or vehicle is shown generally at numeral 10 having a continuous rotatable platform assembly 12 mounted on a turntable assembly 14, the power plant being contained within the platform assembly and functioning as a counterweight for the aerial tower which comprises primary and secondary booms 16 and 18 and associated structure as will be described below.

The mobile platform or vehicle 10 may be of any suitable type, one of which as contemplated in the drawing is of the type known as a "JLG Lift" manufactured by Fulton Industries, Inc., of McConnelsburg, Pa. The turntable and other features of the mobile platform or vehicle are incidental to the invention, although, of course, a turntable is desirable to maximize maneuverability of the aerial tower assembly in an area surrounding the vehicle without necessitating movement of the vehicle.

Figure 2:
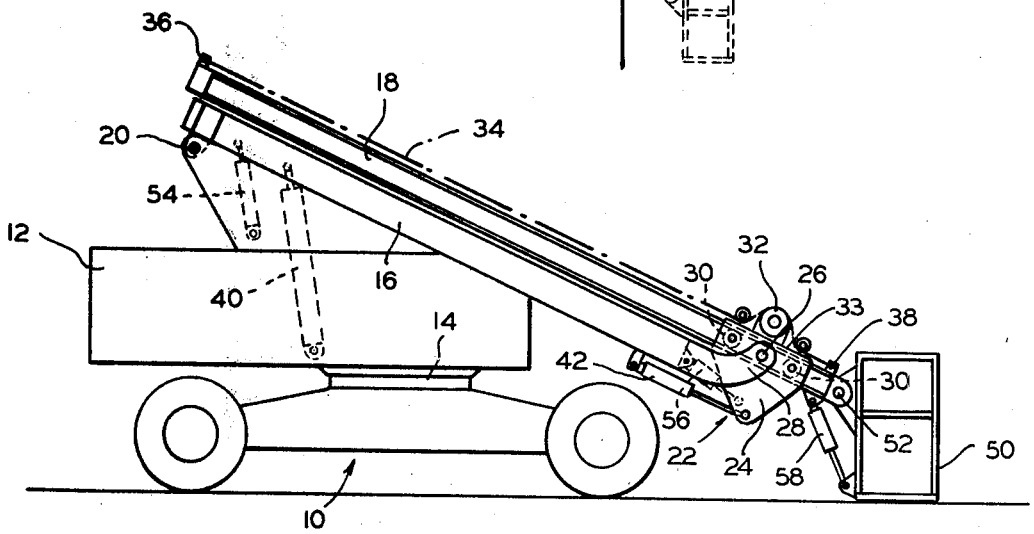
FIG. 2 is a side elevational view of the vehicle and aerial tower.

It will become apparent as the description proceeds that while I have shown but a single side elevational detailed view of my invention, all of the essential characteristics and structure relative thereto will be adequately defined in relation to that view. As will be clearly understood by persons skilled in the art, the booms 16 and 18 and associated carriage assembly, and certain of the hydraulic cylinder actuators are provided in parallel pairs in the actual construction, although only one side of each pair is exhibited in FIG. 2.

The primary boom comprises a pair of parallel, longitudinally extending fixed length booms suitably interconnected transversely for strengthening, as is well-known, and mounted pivotally from a pair of transversely spaced bracket housings 20, one of each of which is shown, at the rear of platform assembly 12, while secondary boom 18, constructed similarly to boom 16, is supported wholly in a carriage assembly 22. The carriage assembly comprises a pair of generally triangular plate members 24 transversely spaced, one of which is shown, and supported pivotably on a stub shaft 26 at each inward side of boom 16 from an upturned end 28 of each remote end of boom 16. Each side of boom 18 comprises an outwardly opening channel member which is supported on a pair of longitudinally spaced rollers 30 which are mounted on shaft members secured inwardly of each carriage member 24 for supporting and guiding movements of boom 18 longitudinal of boom 16. Boom 18 may be driven through carriage 22 guided and supported on rollers 30 and relative to boom 16 by means of a drive motor and sprocket assembly 32 which is a part of the carriage assembly, being mounted transversely of the top thereof on a plate 33. A fixed length chain 34 is anchored at 36 and 38 to opposite ends of at least one side of boom 18 and is adapted to be driven by a drive sprocket of the motor and sprocket assembly 32, whereby the relative position of boom 18 in the carriage assembly is controlled.

A main lift cylinder 40 may be mounted centrally of the platform assembly 12, being connected as shown at the rod end to boom 16 and at the base end interiorly of the platform assembly. One or more cylinders 42 are shown connected at the base end to the underside of boom 16 and at the rod end to one or both of plates 24 of the carriage assembly, whereby to control the pivoted positions of the carriage assembly and of boom 18 on stub shafts 26 from the fully retracted position shown in FIG. 2 to, for example, the vertical or negative lift position shown in FIG. 1 at numeral 44.

An operator's cab or work platform 50 is pivoted at 52 on opposite sides of boom 18 and is maintained in a level condition for any combination of attitudes of booms 16 and 18 by cylinders 54, 56 and 58, cylinder 54 being connected between platform 12 and boom 16 in the rear portion thereof, cylinder 56 being connected between trolley plate 24 and a forward end portion of boom 16, and cylinder 58 being connected between the forward end of boom 18 and the lower portion of cab 50, said cylinders being adapted to be interconnected in slave and master cylinder relationships in known manner to perform a continuous leveling function in respect of the cab 50.

In the exemplary JLG Lift of drive and platform assembly 10, 12 and 14, an operator located in cab 50 is able to control all functions of the vehicle, including vehicular drive, turntable operation, and operation of the booms and carriage assembly. Such controls are not a part of the present invention and are not disclosed herein.

In operation it will now be appreciated that a large variety of combinations of attitudes of booms 16 and 18, such as exemplified in part in FIG. 1, may be readily controlled by variously controlling in selectible and independent sequence the operation of hydraulic cylinders 40 and 42, and by the operation of motor and sprocket assembly 32. Thus, the relative simplicity of my invention to manipulate cab 50 to a large variety of positions of both positive and negative lift and outward reach is enabled particularly by the unique combination of booms 16 and 18 with pivoted carriage assembly 22 supporting boom 18 on boom 16 and guiding the same longitudinally of boom 16 during operation of boom 18 in extension or retraction by motor and sprocket assembly 32 and at any selected pivoted position of carriage assembly 22. Maximum maneuverability and positional variation of cab 50 within the design limitations of boom lengths and the like, is thereby facilitated.

It will be understood by those skilled in the art that modifications may be made in the structure, form, and relative arrangement of parts without necessarily departing from the spirit and scope of the invention. Accordingly, it should be understood that I intend to cover by the appended claims all such modifications which fall within the scope of my invention.

I claim:

1. A mobile aerial tower comprising an elongated first boom mounted at one end from a support means on a first pivot and extending longitudinally to a remote end, a carriage assembly mounted on a second pivot at said remote end for supporting and guiding an elongated second boom which when retracted is adapted to extend in substantial parallel and longitudinally adjacent relation to said first boom, motor means operatively connected to said second boom for actuating it to extend longitudinally outwardly of said carriage assembly and of said first boom from its said retracted position, and actuator means for actuating the first boom about said first pivot and for actuating said carriage assembly with said second boom about said second pivot.

2. A mobile aerial tower as claimed in claim 1 wherein said first boom is pivotally mounted on a vehicle having turntable means for rotating the aerial tower circularly about the vehicle.

3. A mobile aerial tower as claimed in claim 1 wherein said means for elevating and pivoting the first boom and carriage assembly comprises first hydraulic cylinder means connected to the first boom for elevating it about said first pivot and second hydraulic cylinder means connected to the first boom and to said carriage assembly for rotating it to selected angular positions about said second pivot.

4. A mobile aerial tower as claimed in claim 1 wherein a work platform is pivotally connected to the outer end of said second boom, and first, second and third master and slave hydraulic cylinder means are connected to said second boom and the work platform, to said first boom and the carriage assembly, and to said first boom and the support means.

5. A mobile aerial tower as claimed in claim 1 wherein said second boom includes track means, and support and guide roller means mounted on the carriage assembly and engageable with said track means for supporting and guiding said second boom during extension and retraction thereof in relation to said carriage assembly and during pivotal movement of said second boom with said carriage assembly.

6. A mobile aerial tower as claimed in claim 1 wherein said motor means comprises a drive motor and sprocket means mounted on the carriage assembly and engaging a fixed length drive chain anchored at its opposite ends to opposite end portions of said second boom.

7. A mobile aerial tower as claimed in claim 1 wherein a work platform is mounted pivotally from the end of said second boom, and means is provided for maintaining said work platform substantially level during maneuvers of said first and second booms.

8. A mobile aerial tower as claimed in claim 5 wherein said motor means comprises a drive motor and sprocket means mounted on the carriage assembly and engaging a fixed length drive chain anchored at its opposite ends to opposite end portions of said second boom.

9. A mobile aerial tower as claimed in claim 8 wherein said first boom is pivotally mounted on a vehicle having turntable means for rotating the aerial tower circularly about the vehicle.

10. A mobile aerial tower as claimed in claim 1 wherein the remote end of said first boom includes an upturned portion from which said carriage assembly is pivoted for locating said second boom longitudinally of and above said first boom.

11. A mobile aerial tower as claimed in claim 1 wherein manipulation of said second boom in relation to said first boom includes actuation longitudinally thereof through said carriage assembly at any elevation of said first boom and pivotal movement with said carriage assembly at any elevation of said first boom and longitudinal extension of said second boom from a relationship of substantially parallel alignment of said first and second booms to a relationship wherein said second boom is in a substantially vertical position when said first boom is lowered.

12. A mobile aerial tower as claimed in claim 5 wherein manipulation of said second boom in relation to said first boom includes actuation longitudinally thereof through said carriage assembly at any elevation of said first boom, and pivotal movement with said carriage assembly at any elevation of said first boom and longitudinal extension of said second boom from a relationship of substantially parallel alignment of said first and second booms to a relationship wherein said second boom is in a substantially vertical position when said first boom is lowered.

13. A mobile aerial tower as claimed in claim 8 wherein manipulation of said second boom in relation to said first boom includes actuation longitudinally thereof through said carriage assembly at any elevation of said first boom, and pivotal movement with said carriage assembly at any elevation of said first boom and longitudinal extension of said second boom from a relationship of substantially parallel alignment of said first and second booms to a relationship wherein said second boom is in a substantially vertical position when said first boom is lowered.

14. A mobile aerial tower claimed in claim 1 wherein said second boom when thus actuated to extend from its said retracted position is maintainable in substantial parallel relation to said first boom.

* * * * *